US007478813B1

(12) United States Patent
Hofferber et al.

(10) Patent No.: US 7,478,813 B1
(45) Date of Patent: Jan. 20, 2009

(54) DEVICE FOR HOLDING AND VIEWING PLAYING CARDS

(76) Inventors: David A. Hofferber, 101 Cherokee Rd., Lexington, NE (US) 68850; Christopher P. Farrell, 101 Cherokee Rd., Lexington, NE (US) 68850

( * ) Notice: Subject to any disclaimer, the term of this patent is extended or adjusted under 35 U.S.C. 154(b) by 379 days.

(21) Appl. No.: 11/414,944

(22) Filed: May 1, 2006

(51) Int. Cl.
*A63F 1/10* (2006.01)

(52) U.S. Cl. ..... 273/148 A; 273/148 R; D21/392; D21/393; D21/396

(58) Field of Classification Search ..... 273/150, 273/151, 148 A, 148 R; D21/392, 393, 394, D21/395, 396, 397
See application file for complete search history.

(56) References Cited

U.S. PATENT DOCUMENTS 4,146,229 A * 3/1979 Morse ..... 273/150
D286,897 S 11/1986 Herbert
D347,451 S 5/1994 Kazakowitz
5,445,378 A 8/1995 Cook
5,472,198 A 12/1995 Alvarez
D367,082 S 2/1996 Harley
5,590,880 A 1/1997 Flam
D431,052 S 9/2000 Wilcox
6,349,940 B1 2/2002 Nimry
D493,199 S 7/2004 Cowgill

* cited by examiner

*Primary Examiner*—Benjamin H Layno
(74) *Attorney, Agent, or Firm*—Robert C. Montgomery

(57) ABSTRACT

A device for holding and viewing playing cards is herein provided and discloses an apparatus that allows the viewing of playing cards that are placed down on the device for those who have limited use of their hands or would benefit from such a device. The invention takes the form of an angled stand with the approximate dimensions of four inches by six inches where a portion of this area is used to hold the cards face down, as placed there by the dealer or player's assistant, although other sizes and shapes for accommodating multiple card are envisioned. The device is shielded so that adjacent players are denied the ability to view the cards. A dual mirror assembly is visible through a viewing window that is used by the player. In such a manner, players without the use of their hands or arms can see their cards in an easy manner without the aid of another person.

7 Claims, 7 Drawing Sheets

DEVICE FOR HOLDING AND VIEWING PLAYING CARDS

RELATED APPLICATIONS

The present invention was first described in Disclosure Document No. 585,108 filed on Aug. 30, 2005. There are no previously filed, nor currently any co-pending applications, anywhere in the world.

FIELD OF THE INVENTION

An apparatus is provided that allows a person to view playing cards that are placed face-down on the device, without anyone else being able to see them. The invention takes the form of an opaque plastic stand with the approximate dimensions of four (4) inches tall by four (4) inches wide by six (6) inches long. The playing cards are placed on the top part of the viewer by the dealer or any able-bodied person. While this size is good for up to four (4) cards, other sizes are envisioned which would accommodate the use of more cards. With the use of a mirror system, the player can see the cards through a viewing window at the end of the device. The viewing window is angled such that it is impossible for other players to see into it. However, spectators behind the player may be able to get a glimpse of the cards. Players without the use of their hands or arms can see their cards in an easy manner without someone having to show the cards to them.

BACKGROUND OF THE INVENTION

Card games are among the most popular of today's recreational and social activities. Millions of people enjoy the numerous existing card game variations. These games are popular among people of all ages, as they provide a means to gather with friends and socialize. A common factor in just about every type of card game is that a player must hold their cards, most typically in close proximity to one's body, to prevent other players from seeing them. While this is usually a simple and obvious task, it is almost impossible for those with limited use of their hands and/or arms. In cases where a disabled player wishes to play cards, someone else must hold the disabled person's cards and go to great lengths to avoid looking at them, especially if they are also playing. Whatever the reason for not being able to hold one's own cards, it affects their ability to play the card games, making it less enjoyable for all involved. The development of the present invention addresses this issue. While the present invention is most particularly suited for the popular Texas Hold-Em version of poker, it can easily be used for other playing card games.

Several attempts have been made in the past to provide a means to assist disabled persons in holding and viewing playing cards in a secure and sturdy apparatus. U.S. Pat. No. 6,349,940 in the name of Nimry discloses a collapsible game card holding means consisting of a plurality of flexible fingers that are separated and retracted in a fan-like configuration. The Nimry device does not disclose a novel box-like mirror apparatus to provide security from other players' viewing angles.

U.S. Pat. No. 5,590,880 issued in the name of Flam provides a card holder in the form of a shell or shield with slots or pockets into which a plurality of cards are placed. In the Flam device, the card holder is configured in a vertical device, which provides less stability when placed on a horizontal surface. Hence, the Flam device must be held and is therefore not in the scope of the present invention.

U.S. Pat. No. 5,472,198 issued in the name of Alvarez describes a playing card holder with a hand shape with rubber finger tips that is attached to a plate with a spring-biased clip to retain the cards and finger rings on the plate that the player uses to hold the device. The Alvarez device suffers from the same problems as the aforementioned Flam device in that it is designed to be held by the player and, therefore, also does not fall under the scope of the present invention.

U.S. Pat. No. 5,445,378 issued in the name of Cook discloses a playing card holder having an extendable handle attached to a head extension, which is in turn attached to a support plate with a plurality of pockets for retaining playing cards therein. The Cook device is also equipped with a base for supporting the device on a horizontal surface. The Cook device lacks features to eliminate surreptitious viewing from neighboring players and also must be manipulated by hand, which is not necessary with the present invention.

Other, various ornamental designs of playing card holders are prevalent in the prior art, such as U.S. Pat. No. D 493,199, issued in the name of Cowgill; U.S. Pat. No. D 431,052, issued in the name of Wilcox; U.S. Pat. No. D 347,451, issued in the name of Kazakowitz; U.S. Pat. No. D 286,897, issued in the name of Herbert; and U.S. Pat. No. D 367,082 issued in the name of Harley.

None of the prior art particularly describes an apparatus and method for displaying and viewing playing cards in a novel, box-like mirrored assembly that can be placed on a horizontal surface and provides a secure means for viewing said playing cards. Accordingly, there is a need for an apparatus suitable for use by disabled, elderly, novice, or expert players to confidently view playing cards in a secure manner that is also sturdy, resilient, and easy to use.

SUMMARY OF THE INVENTION

In view of the foregoing disadvantages inherent in the prior art, it has been observed that there is a need for a device that secures and displays playing cards.

It has further been observed that there is a need for a device to display playing cards in a secure manner as to eliminate the surreptitious viewing of one's playing cards by a neighboring player.

The object of the invention is to provide such a device to enable a user to secure and display their playing cards only to him or herself.

It is a further object of the invention to secure and display a user's playing cards such that neighboring players cannot see said playing cards, no matter what the viewing angle may be.

It is still a further object of the invention to provide users with a novel mirror system in a box-like structure for the viewing of said playing cards.

It is yet another object of the present invention to provide a device that can be easily placed on a horizontal surface.

Still yet another object of the present invention is to provide means to vertically adjust the viewing angle of the mirror system depending on the position of the user.

To achieve the above and other objectives, the present invention provides a method for displaying and viewing playing cards comprising steps of, providing a novel mirror system in a box-like structure for holding and displaying playing cards; placing said structure onto a horizontal surface in front of the player; placing playing cards face down on a top tray of the structure, such that a top portion of each placed playing card extends over the top tray; reflecting the image of the extended top portion of each placed playing card from an angled bottom mirror onto an interior mirror and through the viewing window to the player; and, adjusting the viewing angle of the reflected image of the placed playing cards by vertically adjusting opposing legs, wherein said leg adjustment manipulates the structure with respect to the horizontal surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
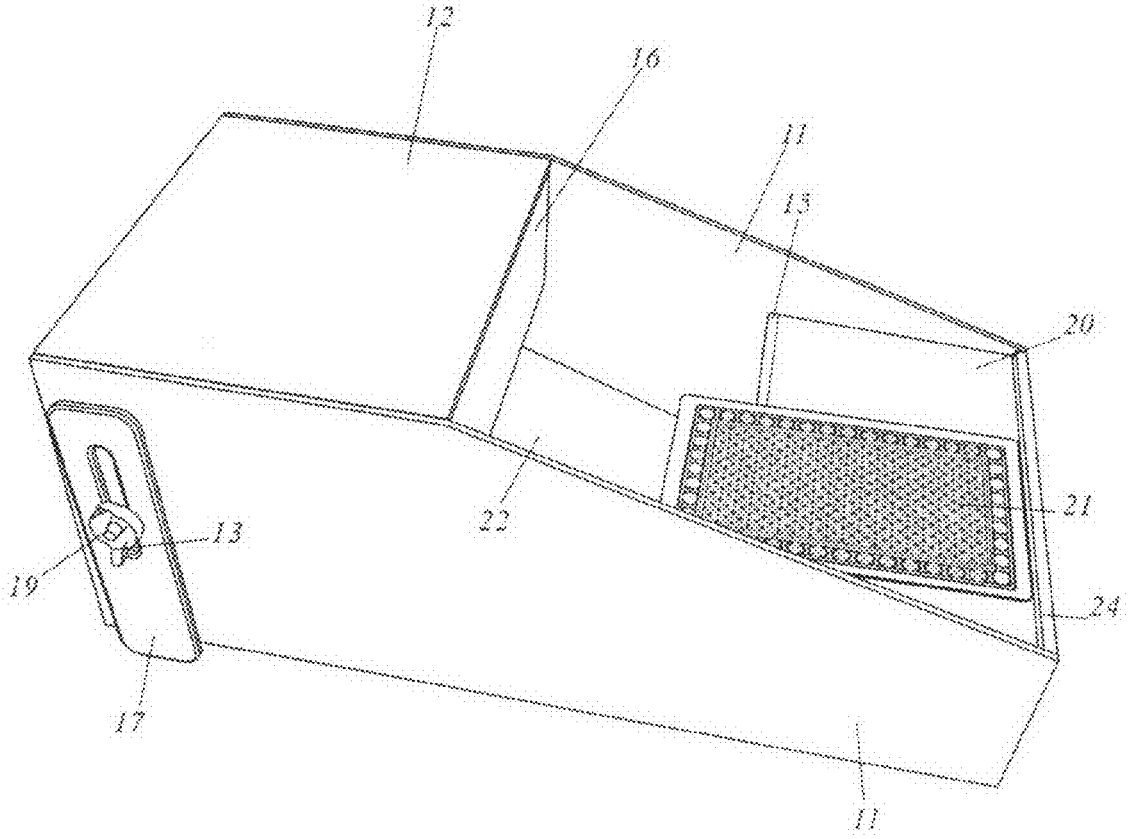
FIG. 1 is a side perspective view of a device for holding and viewing playing cards 10, according to a preferred embodiment of the present invention; and, FIG. 2 is a front elevation view of the device for holding and viewing playing cards 10, according to a preferred embodiment of the present invention; and, FIG. 3 is a side view of the device for holding and viewing playing cards 10, according to a preferred embodiment of the present invention; and, FIG. 4 is a rear view of the device for holding and viewing playing cards 10, according to a preferred embodiment of the present invention; and, FIG. 5 is a top view of the device for holding and viewing playing cards 10, according to a preferred embodiment of the present invention.
Figure 2:
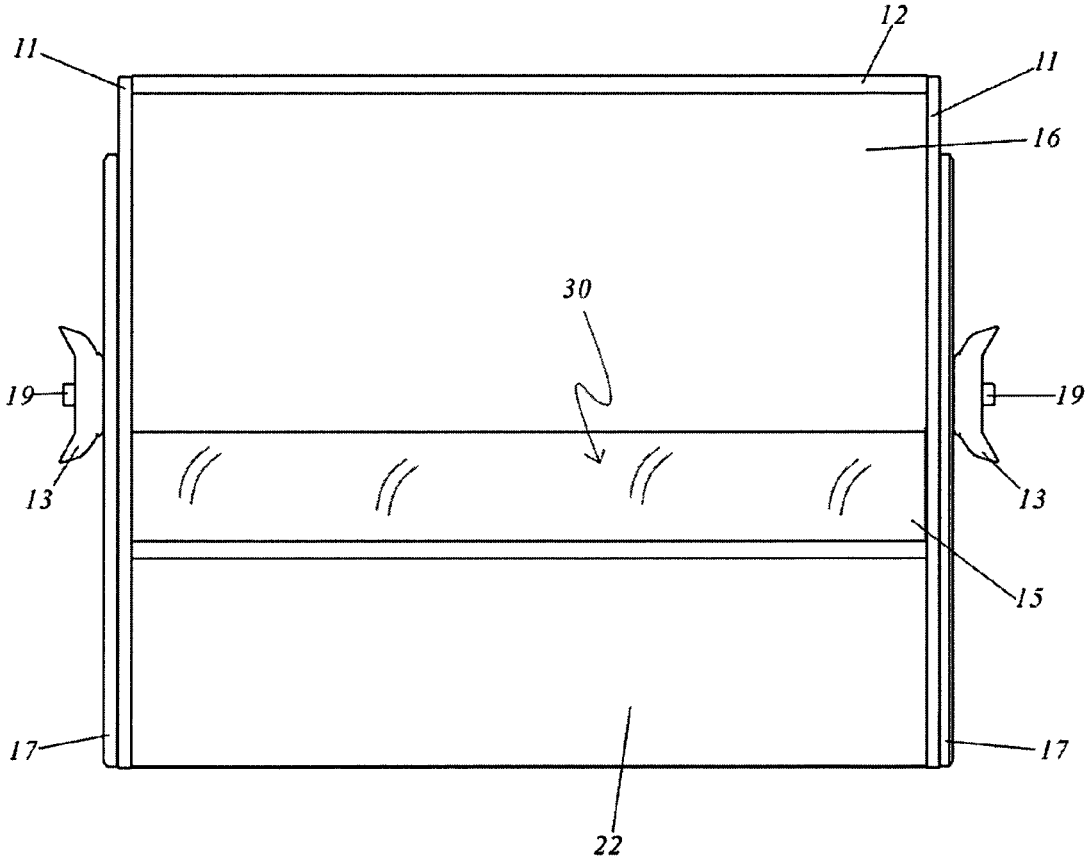
Figure 3:
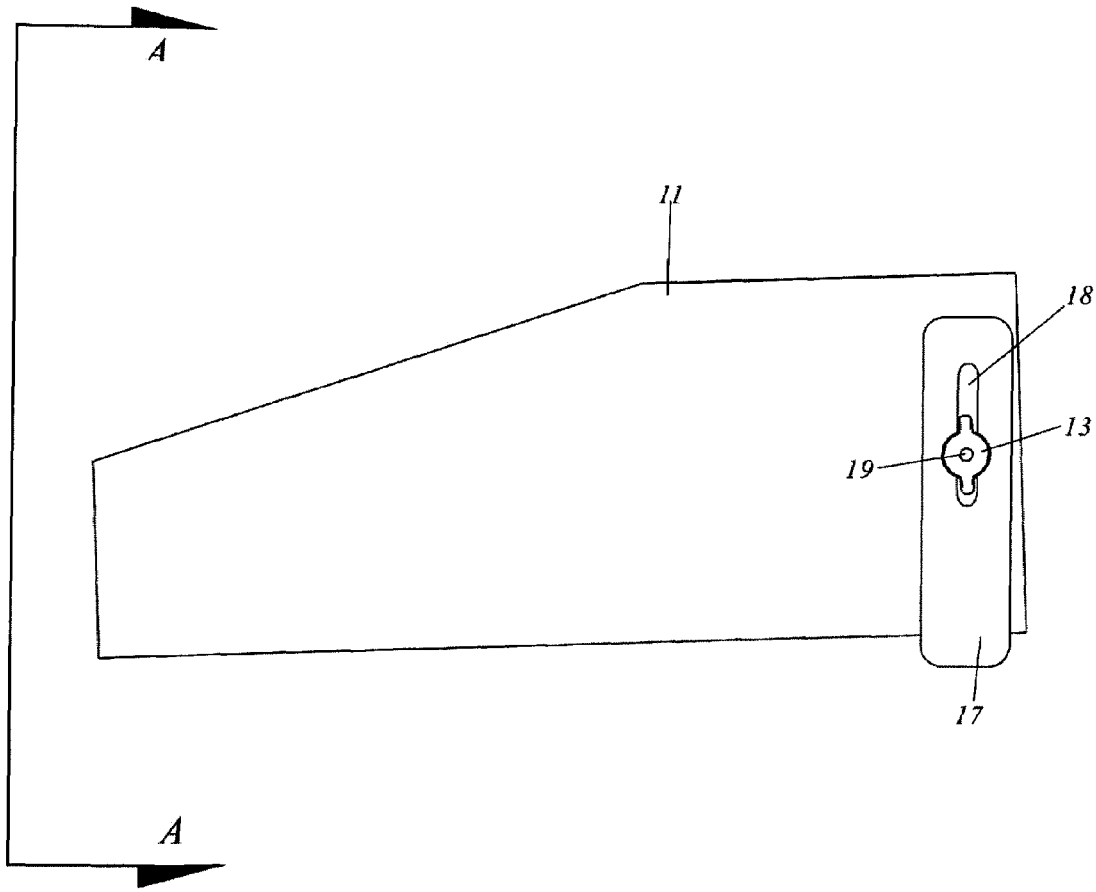
Figure 4:
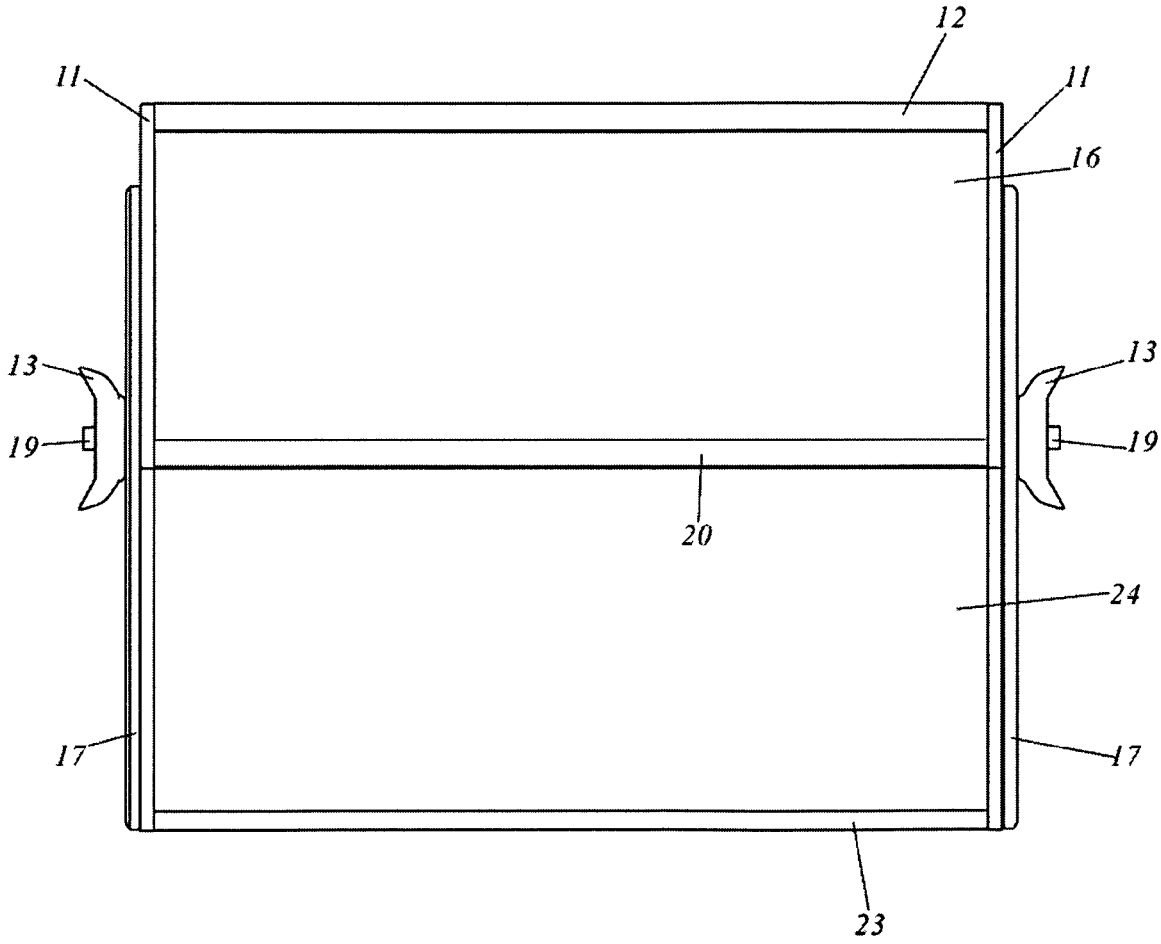
Figure 5:
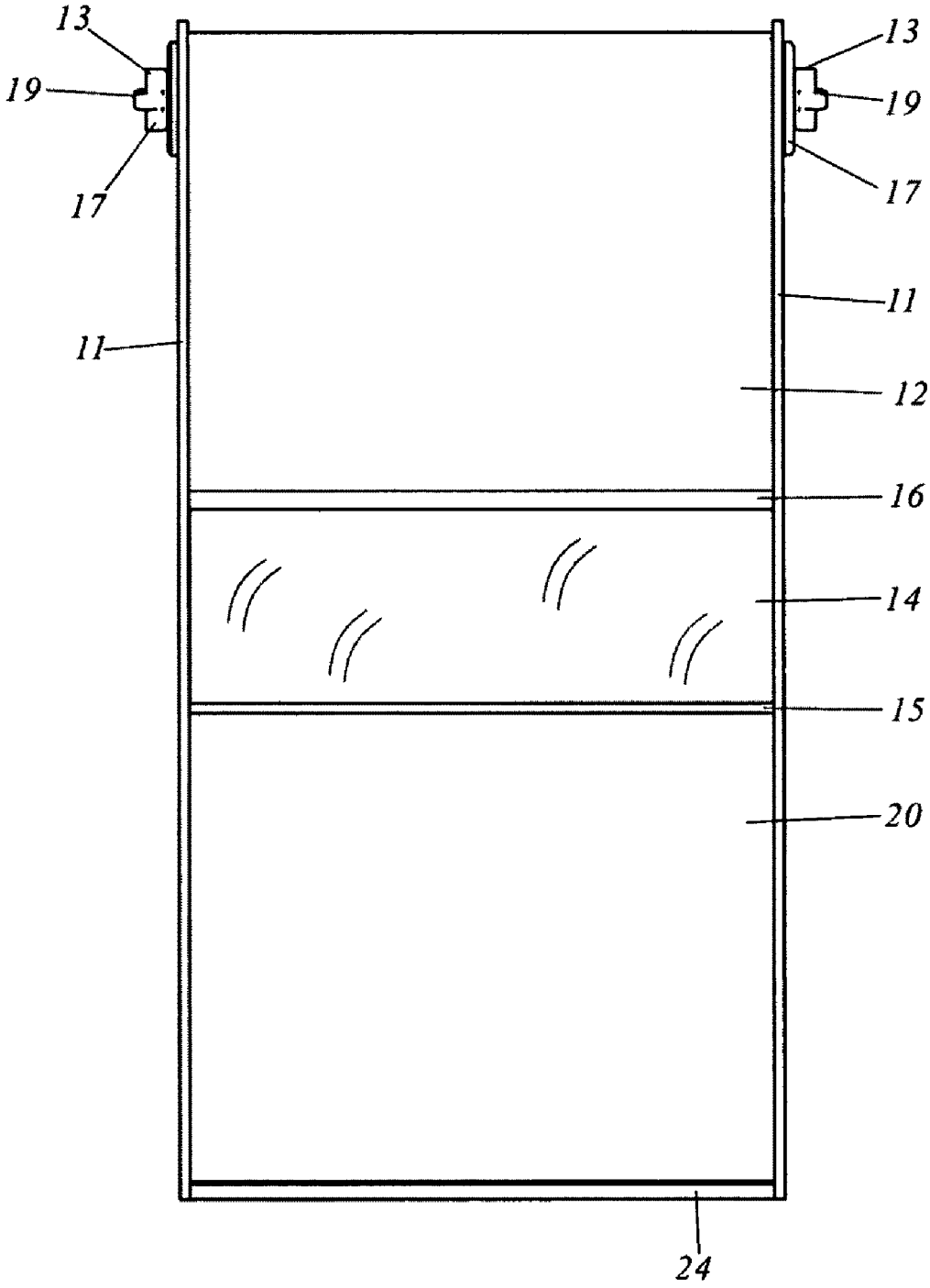
Figure 6:
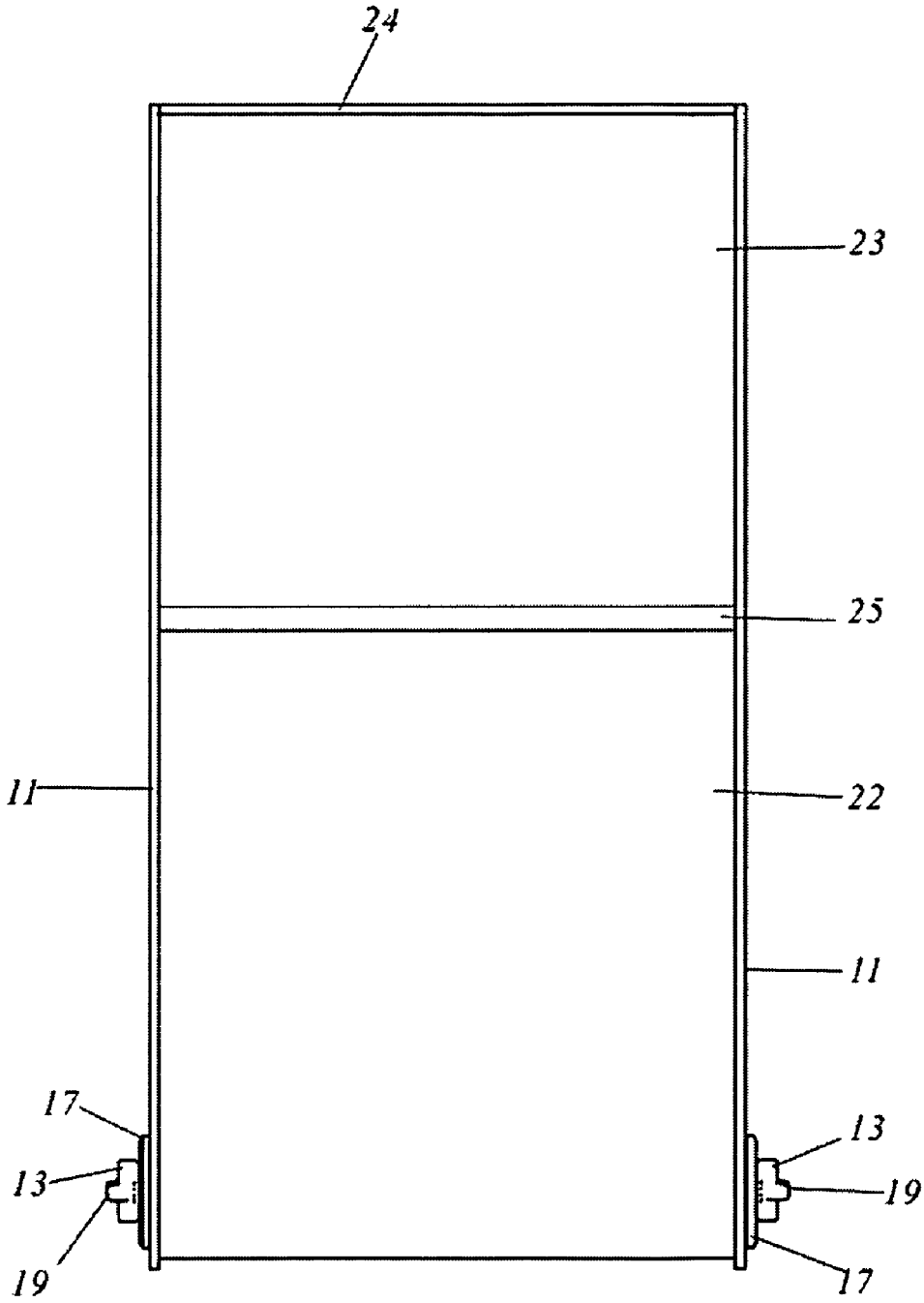
FIG. 6 is bottom view of the device for holding and viewing playing cards 10, according to a preferred embodiment of the present invention; and, FIG. 7 is a sectional view along the lines A-A of FIG. 3, herein showing a sectional view thereof the device for holding and viewing playing cards, according to a preferred embodiment of the present invention.
Figure 7:
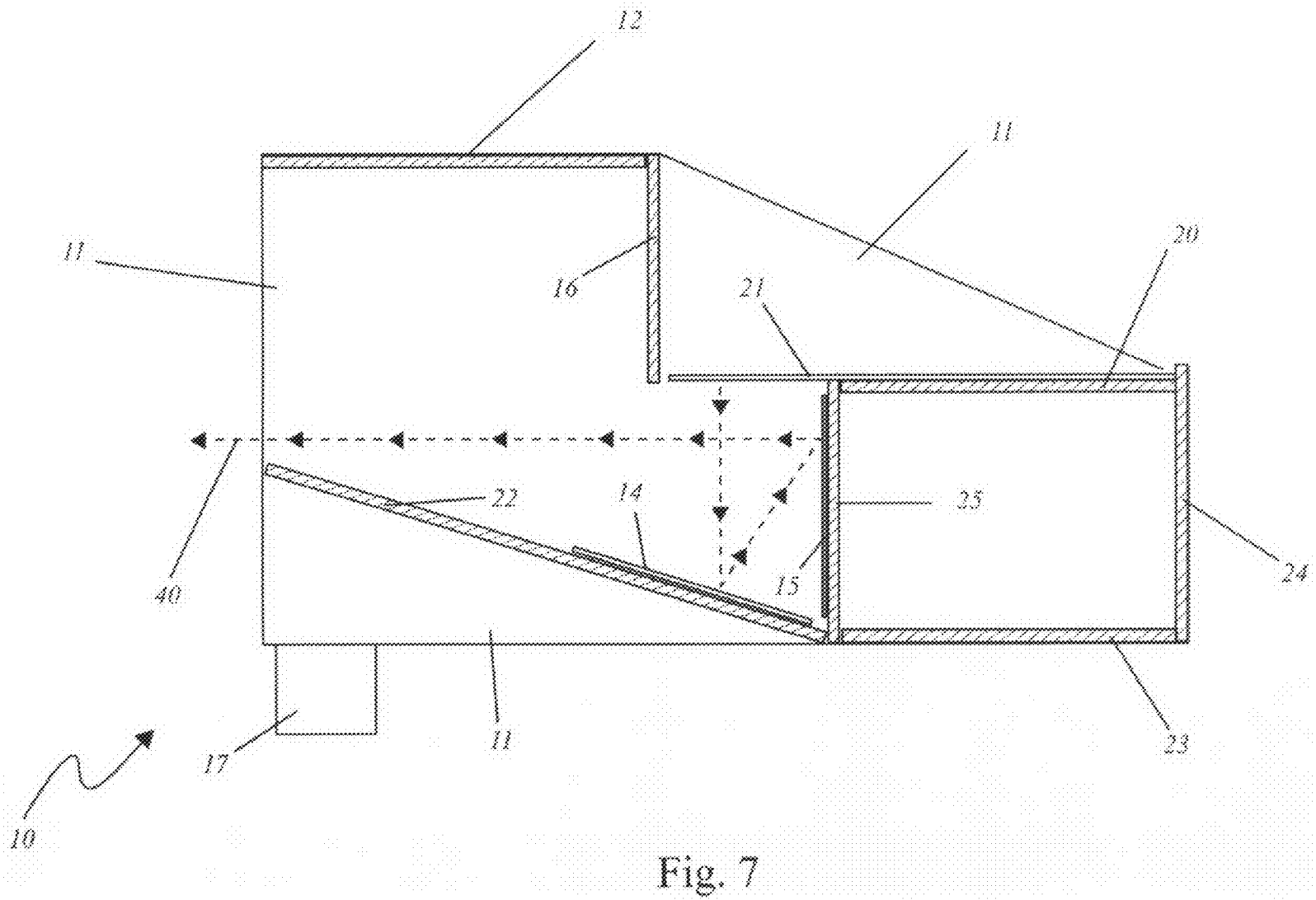

10 device for holding and viewing playing cards
11 side wall
12 top wall
13 wing nut
14 bottom mirror
15 interior mirror
16 upper interior wall
17 leg
18 slot
19 screw
20 playing card surface
21 playing card
22 angled wall
23 bottom wall
24 rear wall
25 lower interior wall
30 viewing window
40 reflected image

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention. Any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 7, various perspective and elevation views of the present invention, a device for holding and viewing playing cards 10 (hereafter referred to as the "device") generally comprising a shielded structure utilizing integral mirror assemblies and adjustable supports, are herein disclosed. The shielded structure comprises a wooden or plastic construction utilizing common adhesive or fastening means such as glue, bonding, or basic mechanical hardware. The preferred embodiment of the device 10 accommodates two (2) playing cards 21, and may be expanded in an alternate embodiment for additional playing cards 21 most commonly associated with popular games.

Two (2) side walls 11 of a semi-trapezoidal shape are oriented opposite from each other and define an interior space within. Attached to an intermediary vertical location on both the side walls 11, and extending from the leading edge of said side walls 11 in a downwardly slanting direction to the bottom edge of the side walls 11 at a location short of the corners, is a rectangular plate defining an angled wall 22. A second rectangular plate defines a bottom wall 23 extending rearward from the connection point of the angled wall 22 to each side wall 11 to the bottom rear corners of each side wall 11. A rear wall 24, shaped as another rectangular plate, extends upward from the bottom rear corners of the side walls 11 perpendicular to the bottom wall 23 to the lower vertical points of the side walls' 11 trapezoidal shape. A fourth rectangular plate, defining a playing card surface 20, spans the width defined by the side walls 11 and a length approximately half of a conventional playing card 21 projecting towards the front of the device 10. Extending upward from the lower connection point of the bottom wall 23 and side walls 11 to the playing card surface 20 is a lower interior wall 25, opposing and equal in dimension to the rear wall 24, and also constructed as a rectangular plate. Yet another rectangular plate defines a top wall 12, which extends from the front upper corners of the side walls 11 to the upper vertical point of the side walls' 11 trapezoidal shape. A seventh rectangular plate finally defines an upper interior wall 16, which extends downward from the connection point of the side walls 11 and top wall 12 to an intermediary point along the interior surfaces of the side walls 11, roughly equal to the height of the playing card surface 20. The area defined therein by the top wall 12, both opposing side walls 11, and the angled wall 22 is known as the viewing window 30, permitting the unhindered viewing of the reflected image 40 of the playing cards 21 onto the interior mirror 15.

Two mirrors are placed within the device 10 for projecting an image 40 of a playing card 21 to the user viewing through the front of the device 10. A rectangular interior mirror, 15 shaped to match the width of the interior space defined by the side walls 11, is affixed to the lower interior wall 25, via adhesive or other similar adhering means, with a height not exceeding that of the lower interior wall 25. A second rectangular bottom mirror 14 is affixed on the angled wall 22 via an adhesive or other adhering means. The location of the angled wall 22 and hence, the bottom mirror 14, is dependent on the ability to easily view the projected image 40 of the playing cards 21 placed on and extending past the playing card surface 21.

Referring now to FIG. 1, which depicts the device 10 in a side perspective view, one (1) of an identical pair of adjustable legs 17 is easily shown. Each leg 17 is a rectangular-shaped plate with or without rounded edges and a long edge typically not exceeding that of the height of the side walls 11 at their highest point, and is affixed to each side wall 11 at the leading front edge. Each leg 17 has an oval-shaped slot 18 formed in its interior with a diameter matching that of a conventional screw 19 or similar piece of hardware. The screw 19 is fed through a pre-drilled hole through the side wall 11 and the slot 18 of the leg 17. A wing nut 13 or other similar device secures the leg 17 by threaded attachment to the screw 19.

The preferred embodiment of the present invention is designed to be used by a person with no special skills or training being necessary, but most typically is intended for the handicapped or those unfortunate enough to have limited or no use of their hands. After procurement of the device 10, an apparatus for holding and viewing playing cards 10, the user sets the bottom wall 24 of the device 10 in front of them on a table or other horizontal surface such that the device 10 is positioned to be easily viewed by the player, with the front of the device defined as the portion where the mirrors 14, 15 are most easily seen and the legs 17 are in the front. If necessary, the legs 17 of the device 10 may be adjusted to allow the user to see the interior by loosening the wing nut 13, adjusting the legs 17 upward or downward with the screw 19 in the adjustment slot 18, and, re-tightening the wing nut 13 on the screw 19. This enables the viewing angle through the viewing window 30 to change depending on the desires of the player.

Once the desired height of the device 10 has been set, the bottom mirror 14 must be placed on the angled wall 22 near its lowest point, so that it abuts the interior mirror 15, if previously installed. If the interior mirror 15 is not previously installed, it must be placed in a position such that it is laid flat against the lower interior wall 25. Then, when the user is ready to receive the playing cards 21, the dealer or player's assistant places the playing cards 21 face down onto the playing card surface 20, ensuring that an ample portion of each playing card 21 extends over the surface 20. The portion of the playing card 21 that extends over the surface 20 has its image then projected onto the bottom mirror 14. If one views this image, the common property of a reversed image from a mirror is readily observed. However, with the proper angle of the angled wall 22, and henceforth the bottom mirror 14, the bottom mirror 14 projects the reversed image 40 of the playing cards 21 onto the interior mirror 15, which reverses it again, resulting in a "true" representation of the playing cards 21. Therefore, the user merely has to view the interior mirror 15 to see the image 40 of the card(s) 21 placed on the playing card surface 20. The upper interior wall 16, lower interior wall 25, top wall 12, and side walls 11 act as a shield from adjacent players surreptitiously viewing an opponent's playing cards 21.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A device for holding and viewing playing cards comprising:

a structure, wherein said structure further comprises:

two opposing side walls, each of which are semi-trapezoidal in shape with a first height and a second height, a front end and a rear end, and a top edge and a bottom edge;

an angled wall of rectangular shape of a particular width with a front edge fixedly attached to an intermediary vertical location on said front end of each of said side walls and a rear edge fixedly attached to an intermediary horizontal location at each of said bottom edge of said side walls, said angled wall joins together said side walls, wherein said intermediary horizontal location is located to the rear of the horizontal location of said first height and said angled wall is positioned to achieve a viewing angle;

a bottom wall of rectangular shape with a width corresponding to the width of said angled wall with a front edge fixedly connected to said rear edge of said angled wall and a rear edge fixedly connected to a point at said rear end and said bottom edge of each of said side walls;

a rear wall of rectangular shape with a width corresponding to the width of said angled wall and a bottom edge perpendicularly fixedly connected to said rear edge of said bottom wall and a top edge fixedly connected to said second height of each of said side walls;

a playing card surface with a shape and size corresponding to said bottom wall with a rear edge perpendicularly fixedly connected to said top edge of said rear wall and a front edge fixedly connected to an intermediary location vertically opposite that of said bottom wall, said playing card surface is in parallel orientation with said bottom wall, a lower interior wall with a shape and size corresponding to said rear wall with a top edge perpendicularly fixedly connected to said front edge of said playing card surface and a bottom edge perpendicularly fixedly connected to said front edge of said bottom wall, wherein said rear edge of said angled wall abuts said lower interior wall;

a top wall with a front edge fixedly connected to a point at said front end and said first height of each of said side walls and a rear edge fixedly connected to said first height of each of said side walls; and, an upper interior wall with a top edge perpendicularly connected to said rear edge of said top wall and a bottom edge fixedly connected to an intermediary location of said side walls vertically downward, said intermediary location corresponding to at least the height of said second height of each of said side walls;

a mirror system; and, a vertical adjustment means for said device.

2. The device in claim 1, wherein said playing card surface has a length smaller than a conventional playing card.

3. The device in claim 1, wherein said mirror system further comprises a bottom mirror for removable placement on said angled wall and an interior mirror for removable placement on said interior wall, said interior mirror receives an image reflected from said bottom mirror placed at said viewing angle to reflect said image through said device to a user, said image is from an object placed on said playing card surface and extending over said front edge of said playing card surface.

4. The mirror system of claim 3, wherein said bottom mirror and said interior mirror may be permanently fixed to said angled wall and said interior wall, respectively.

5. The device of claim 1, wherein said vertical adjustment means comprises two rectangular legs with an interior slot for receiving attachment means and retention means for setting a vertical adjustment, said attachment means attaches each leg to the exterior surface of said front end of said side walls.

6. The vertical adjustment means of claim 5, further comprising rounded-off corners, and a wing nut for said retention means.

7. A method for holding and displaying playing cards, comprising the steps of:

providing a structure further comprising:

two opposing side walls, each of which are semi-trapezoidal in shape with a first height and a second height, a front end and a rear end, and a top edge and a bottom edge;

an angled wall of rectangular shape of a particular width with a front edge fixedly attached to an intermediary vertical location on said front end of each of said side walls and a rear edge fixedly attached to an intermediary horizontal location at each of said bottom edge of said side walls, said angled wall joins together said side walls, wherein said intermediary horizontal location is located to the rear of the horizontal location of said first height and said angled wall is positioned to achieve a viewing angle;

a bottom wall of rectangular shape with a width corresponding to the width of said angled wall with a front edge fixedly connected to said rear edge of said angled wall and a rear edge fixedly connected to a point at said rear end and said bottom edge of each of said side walls;

a rear wall of rectangular shape with a width corresponding to the width of said angled wall and a bottom edge perpendicularly fixedly connected to said rear edge of said bottom wall and a top edge fixedly connected to said second height of each of said side walls;

a playing card surface with a shape and size corresponding to said bottom wall with a rear edge perpendicularly fixedly connected to said top edge of said rear wall and a front edge fixedly connected to an intermediary location vertically opposite that of said bottom wall, said playing card surface is in parallel orientation with said bottom wall, a lower interior wall with a shape and size corresponding to said rear wall with a top edge perpendicularly fixedly connected to said front edge of said playing card surface and a bottom edge perpendicularly fixedly connected to said front edge of said bottom wall, wherein said rear edge of said angled wall abuts said lower interior wall;

a top wall with a front edge fixedly connected to a point at said front end and said first height of each of said side walls and a rear edge fixedly connected to said first height of each of said side walls;

an upper interior wall with a top edge perpendicularly connected to said rear edge of said top wall and a bottom edge fixedly connected to an intermediary location of said side walls vertically downward, said intermediary location corresponding to at least the height of said second height of each of said side walls;

a mirror system further comprising a bottom mirror for removable placement on said angled wall and an interior mirror for removable placement on said interior wall, said interior mirror receives an image reflected from said bottom mirror placed at said viewing angle to reflect said image through said device to a user, said image is from an object placed on said playing card surface and extending over said front edge of said playing card surface; and, a vertical adjustment means further comprising two rectangular legs with an interior slot for receiving attachment means and retention means for setting a vertical adjustment, said attachment means attaches each leg to the exterior surface of said front end of said side walls;

placing said structure onto a horizontal surface, adjusting said mirror system therewith said vertical adjustment means, placing a playing card on said structure, viewing an image of said playing card reflected by said mirror system.

* * * * *